United States Patent [19]

Wesner et al.

[11] 4,346,821

[45] Aug. 31, 1982

[54] CHILD-RESISTANT CLOSURES FOR CONTAINER MOUNTED SPRAY DISPENSERS

[75] Inventors: Walter H. Wesner, Plantation; Fred E. Wallace, Boca Raton, both of Fla.

[73] Assignee: AFA Consolidated Corporation, Hialeah, Fla.

[21] Appl. No.: 8,222

[22] Filed: Jan. 31, 1979

Related U.S. Application Data

[63] Continuation-in-part of Ser. No. 887,144, Mar. 16, 1978, abandoned.

[51] Int. Cl.[3] ..... B67D 5/42

[52] U.S. Cl. ..... 222/153; 215/274; 222/321; 222/536

[58] Field of Search ..... 222/402.11, 525, 531, 222/534, 536, 538, 546, 556, 557, 561, 153, 321, 402.13, 383, 385; 239/288; 215/201, 213, 225, 216, 274; 251/147; 137/381; 220/281

[56] References Cited

U.S. PATENT DOCUMENTS

| | | | |
|---|---|---|---|
| 2,971,680 | 2/1961 | Wilson . | |
| 3,104,039 | 9/1963 | Dike | 222/536 |
| 3,650,473 | 3/1972 | Malone | 222/383 X |
| 3,655,099 | 4/1972 | Hazard | 222/534 X |
| 3,759,426 | 9/1973 | Kane et al. | 222/385 |
| 3,786,964 | 1/1974 | Landen | 222/536 X |
| 3,830,392 | 8/1974 | Kessler et al. . | |
| 3,865,313 | 2/1975 | Kondo | 222/383 X |
| 3,927,834 | 12/1975 | Tada | 222/383 X |
| 3,973,700 | 8/1976 | Schmidt et al. | 222/153 |
| 4,117,945 | 10/1978 | Mumford | 215/216 |
| 4,144,983 | 3/1979 | Pauls et al. | 215/216 |

*Primary Examiner*—Howard N. Goldberg
*Assistant Examiner*—Fred A. Silverberg
*Attorney, Agent, or Firm*—Arthur H. Swanson

[57] ABSTRACT

A child-resistant safety closure is provided for closing the outlet of a hand-operated fluid product sprayer dispenser used on a container to prevent leaks from the container during periods of non-use and to resist accidental use by children or unwary adults. The closure cannot be moved from an "outlet closed" position to an "outlet open" position without the performance of at least two discrete, predetermined definite actions by the user to first disable a lock and then to linearly or rotatably move the cap into the "outlet open" position to permit spraying or dispensing. A closing member is connected to the bottom portion of the sprayer for removably mounting the sprayer to the container and closing the same. The member and the sprayer to which it is connected cannot be removed without the performance of at least two discrete, predetermined definite actions, which actions are difficult if not impossible for young children to perform.

9 Claims, 17 Drawing Figures

CHILD-RESISTANT CLOSURES FOR CONTAINER MOUNTED SPRAY DISPENSERS

This application is a continuation-in-part of application Ser. No. 887,144 filed Mar. 16, 1978 and now abandoned.

BACKGROUND OF THE INVENTION

1. Field of the Invention

The invention is concerned with fluid product dispensers packaged with fluid containers and, in particular, with closures or overcaps for the dispenser fluid product outlet and closing connectors for removably mounting them on the containers which, for safety reasons, can be operated only in such a manner as to make their operation and removal difficult by children or unwary adults. Spray dispensers are frequently used with containers for dispensing various household cleaning products which may contain lye, ammonia or some other injurious agent which could be harmful to children if operated or removed inadvertently by them.

2. Description of the Prior Art

Fluid product dispensers for use with containers when mounted thereon, particularly of the type which produce a spray are generally known in the art, for example, as disclosed in U.S. Pat. No. 3,061,202, but all have the common problem of preventing leakage when packaged with by mounting them on containers of fluid during shipment and preventing inadvertent operation or removal of the spray mechanism. One attempt at solving this problem is disclosed in the U.S. Pat. No. 3,650,473 to Carl E. Malone wherein a cap is provided for the spray outlet in two versions, the first of which includes a domed cover closing the spray outlet and held in place by a screw cap. A seal is effected around the outlet by the action of the screw cap on an annular flange on the cover clamping it between the cap and the nose of the sprayer. The sprayer is made operative by cutting off the dome of the cover with a knife. In the other version shown in the Malone patent, a permanent cap is provided about the nose portion of the sprayer and a removable cover cap or closure is provided to be pushed on with a tight fit over the permanent cap and has a sealing nub which blocks the spray outlet hole. This cover cap is attached to the permanent cap by an integrally molded hinge so that the cap is always available. The sprayer however, can be removed with relative ease from the container by the simple act of unscrewing its bottom connected bottle cap 16.

In another U.S. Pat. No. 3,973,700 to Edward C. Schmidt et al, a sprayer is shown having a combined spray outlet cover and operating trigger. The cover-trigger is pivoted so that it can be swung from an outlet covered or cap position to a trigger operating position and is intended to be in the outlet covered position when the sprayer is not in use. A projection on the outer end of the trigger covers the spray outlet when the trigger is in the up position. A break-off disc is provided to make it impossible to move a tab to adjust the nozzle but the trigger can still be rotated downwardly enough to uncover the spray outlet without breaking off the disc. Spraying can then be accomplished by squeezing a pumping bellows by operation of the trigger with the fingers which would seem to be a likely action for both children and adults. In addition, the sprayer can be removed from the container on which it is used rather easily by unscrewing its cap 14.

In another U.S. Pat. No. 3,957,181 to Robert E. Hazard a closure for a non spray dispenser outlet is provided wherein a spout having a through passage is mounted atop the dispenser in such a way that it can rotate through a 90 degree arc from a transverse position relative to the outlet with its through passage also transverse and therefore not in alignment with the outlet, to a vertical position with the through passage aligned with and open to the outlet. The spout is adapted to rotate to these positions with a cylindrical surface sliding on the face of the outlet. A locking tab is provided at the outer end of the spout which must be deflected with a finger before the spout can be lifted and rotated to the open, vertical position. The dispenser is intended for permanent attachment to a container and cannot be removed without damage for refilling.

Another non-spray dispenser closure cap is shown in U.S. Pat. No. 4,022,352 wherein an integrally-hinged cap is adapted to fold over and close an outlet in the top of the dispenser by plugging the outlet. A latch is provided on the opposite side of the cap from the hinge which can be pried outwardly with the fingers to release it so that the cap can be lifted and the outlet opened again. The device can be removed from the container on which it is mounted only with difficulty and will probably be damaged irreparably in the process.

Yet another non-spray dispenser closure cap is shown in U.S. Pat. No. 4,020,981 wherein an operable screw cap is applied to the top of a simple dispenser for flowable materials and the cap is made difficult to open unless it is rotated a quarter turn and then lifted, or, in another embodiment, rotated another quarter turn back in the opposite direction to open a path to the flowable material. The entire assembly, however, is relatively easily removed from the container by unscrewing.

Various other U.S. Patents have issued which disclose trigger sprayers with bottom connected caps including screw on and pressed on types for attachment to the necks of containers. For example, U.S. Pat. No. 3,927,834 discloses a locking member for locking an actuator or trigger in a non-operating position when the sprayer is out of use, in which position a valve is closed by a piston connected to the trigger to prevent leakage through the sprayer outlet from a container on which the device is used, at the same time a vent hole is covered preventing leakage from that source. However, this device, as with previously mentioned devices, has the disadvantage of being relatively easily operated since mere depression of the trigger unlocks the device and uncovers the vent hole. In addition, the sprayer is relatively easily removed even by a child by the simple act of unscrewing the cap connecting it to the container, hence no provision is made to prevent the child from gaining direct access to its contents.

In addition to the foregoing showings, it is known in the art to use a simple push-on annular cap or cover over the sprayer outlet nose piece of a spray dispenser to close it and which is removed simply by prying it off. Typical of such a cap is shown as prior art in FIG. 9 of the drawings herein. It should be noted that this type of cap serves only to close the outlet of the spray dispenser and must be removed entirely from the nose piece before spraying can be accomplished. Rotation of the cap on the nose piece has no effect on its outlet closure aspects since the outlet remains blocked regardless of this type of movement.

As will become more clearly apparent from what follows the present invention resolves the aforementioned problems and overcomes the disadvantages arising therefrom by the provision of a child-resistant closure for the outlet of a sprayer-pump used on a container including a child-resistant container closing and mounting device which forms a safe, child-resistant, but refillable package of material.

Certain terms well known to the art of the present invention will be used herein and will, it is to be hoped, provide an aid in gaining a better understanding and appreciation of the invention. One of these, "dispensing closure" is applied to a relatively well known type of device which is fitted to a container to provide a closure or cover therefor to seal the contents of the container, or to contain them without leakage in normal usage, combined with other devices by which the contents of the container may be emptied. Under this designation, a two-part device employing a cap and one or more spouts or pouring fitments combined therewith will be found and described, as in previously mentioned U.S. Pat. No. 3,957,181. Not really included within the above definition, although related thereto, are the so-called, two-part devices exemplified in previously mentioned U.S. Pat. No. 3,061,202. These devices are usually characterized by having sprayers with connecting screw-on closure caps and the like attached for installing or mounting the sprayer onto the mouth or neck of a container. These devices, more commonly better known as "trigger sprayers" which designation will be adopted herein, also commonly employ a dip tube, or other inlet conduit means to conduct the material contents from the container to the pump in the sprayer for spraying by ejecting the same through the outlet or exit nozzle of the sprayer. In addition, these devices incorporate associated inlet and outlet check valves contained in the housing of the sprayer to control the flow of the material contents pumped from the container.

The terms "child-resistant" and "child-resistant effectiveness" have recently become known and are used both in the field of the present invention and in the more general area of closures and dispensers to designate devices and packages so constructed that they are significantly difficult or young children, particularly preschool children under 5 years of age, to open within a reasonable time while, at the same time, are not difficult for average, normal adults to open. Such devices when used on containers of toxic, harmful and other hazardous or injurious materials also constitute "Special Packaging" as defined in Part 1700.1 (4) of the Code of Federal Regulations, Title 16 under the pertinent statute. Title 15 United States Code, Section 1471–1475 thereof, entitled "Poison Prevention Packaging Act of 1970", to which reference may be had for further information, said regulations, by reference, being incorporated herein.

Other terms, unless otherwise stated, will take their meaning from the appertaining, incorporated by reference, regulations referred to including any and all standards established for protecting children from serious illness or personal injury from handling, ingesting or using substances contained in these packages and found in the average home or household. All testing procedures to which constructions according to the present invention are described as being subjected will refer to the protocol for testing "Special Packaging" in the Regulations, specifically under Section 1700.20 of Title 16 C.F.R., paragraphs (a), (b) and (c) thereof, also, by reference, incorporated herein.

SUMMARY OF THE INVENTION

Among the objects of the present invention is to provide a safety closure for a dispenser used on a container, the material contents of which is to be expelled by the dispenser.

Another object is to provide a safety closure for a sprayer outlet of the character referred to which is movable over the outlet between a position in which the outlet is open and a position in which the outlet is closed and locked in child-resistant relation.

Still another object of the invention is to provide a safety closure for a sprayer outlet of the character referred to in which the dispenser includes a safety closing device for connecting the dispenser to a container.

A further object of the invention is to provide a device of the character described which forms a safety package of a manually operated sprayer pump and a container of fluid to be expelled, the pump having an outlet through which the container's contents are expelled provided with a child-resistant cover or overcap and a child-resistant closing member connected to the sprayer for removably attaching the sprayer to the container.

A still further object of the present invention is to provide a sprayer device of the type referred to wherein the parts and components are all, or nearly all comprised of low cost, readily available synthetic and/or natural thermoplastic materials.

An additional object of the present invention is to provide a closure device of the preceding type for a sprayer with closing and mounting members in which the sprayer is trigger operated, the closure is a child-resistant overcap slidably engaged over the outlet of the sprayer and the closing member comprises wedge-like rib elements which are adapted to interengage with similar elements on the container when the sprayer is mounted on the neck or mouth thereof.

A still additional object is to provide a closure and a closing member for a sprayer of the preceding type which may be molded of the thermoplastic materials referred to in the economical way and in which the interengaging elements of the closing member and the container are molded as integral parts thereof.

In accomplishing these and other objects there is provided according to the present invention, an improvement in closures for sprayers and like dispensers which are child-resistant, and which can be shipped while the sprayer is mounted on filled containers thereby forming a safe, non-spillable, non-leaking package. Moreover the invention, in addition to affording protection against unwanted, inadvertent or accidental spraying of material from the container, also prevents accidental or inadvertent removal of the sprayer thereby protecting young children by preventing them from gaining direct access to the container contents. The improvements involve special packaging and the use and addition of child-resistant elements to the closures and closing members of a sprayer which when mounted on a container results in a safe, shippable package of hazardous materials of at least 85% child-resistant effectiveness. By child-resistant effectiveness is meant that certain prerequisite procedures must be followed to spray material through the sprayer outlet or to remove or unpackage the sprayer and open the container, which procedures, as will be seen, are effective to prevent at least 85% of normal children under 5 years of age from gaining indirect access to the contents of the container by operating the sprayer, or direct access by removing the sprayer from the container. At the same time the procedures are also effective to permit at least 90% of normal adults between the ages of 18 to 45 to open the packages for either spraying or for refilling by removing the sprayer.

In a preferred improvement, at least a child-resistant cover or overcap is provided for the outlet of the sprayer through which material from the container may be ejected in normal use which is fitted over the outlet in such a manner that it cannot be moved, or have its position altered unless certain prerequisite procedures are strictly followed to uncover the outlet and permit passage of the material contents of the container through the outlet.

As will be seen from the description and drawings which follow, the present invention differs significantly from the previously described devices in a number of aspects including the previously referred to prerequisite procedures and the fact that two distinct and discrete motions, not likely to be used by young children or unwary adults, are necessary to be performed before the sprayer can be either operated for spraying or removed from the container for refilling.

DETAILED DESCRIPTION OF THE INVENTION

Figure 1:
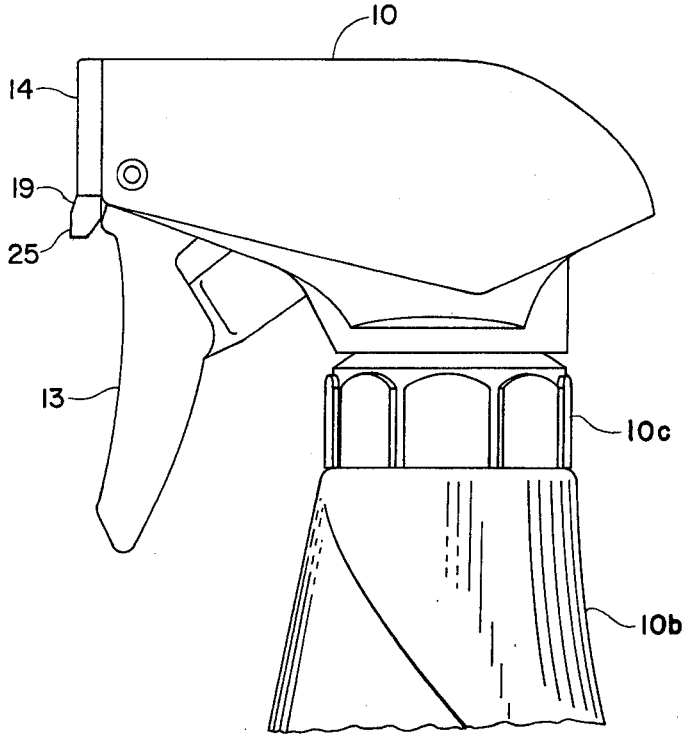
FIG. 1 is an elevation of a spray dispenser with the safety closure of a preferred embodiment of the invention in place over the outlet of the dispenser and in its outlet closed position.

In a preferred embodiment of the present invention, a trigger sprayer or dispenser 10 as seen in FIG. 1, has an end portion in which an outlet 11 contained in a nose piece or nose bushing 12 is inserted, as seen in FIGS. 2-4 and 7. Nose piece 12 comprises, substantially a hollow cylinder press fitted in a bore **10*a* in the end portion of dispenser or sprayer 10 in fluid product sealing relationship to bore 10*a* with said outlet 11 toward the left or facing outwardly. Spray or dispensing outlet or orifice 11 establishes fluid communication between the interior of sprayer 10 via nose piece 12 to the atmosphere, as will be seen. Sprayer 10 is adapted to expel and emit a fluid product, usually a liquid, from the reservoir, container or bottle 10*b* on which it is mounted on the neck 10*c* thereof, by means of a pump operated by the action of a trigger 13 which is biased by a spring to return to its initial, or at rest position shown in FIG. 1**. As mentioned previously, in these devices it is generally always desirable to provide some means such as a cover or an overcap over the sprayer outlets to keep the fluid product from leaking through the uncovered outlet during periods of non-use or when the sprayer is operated as by a child or unwary adult.

It is also desirable for the structure of the various parts involved in the present invention to be made of molded plastic having some resiliency and good dimensional stability such as polyethylene, polypropylene, an acetal copolymer or another plastic having at least these qualities in addition to other qualities that are needed such as sufficient strength, impact resistance and compatibility with the particular fluid product to be sprayed.

Figure 2:
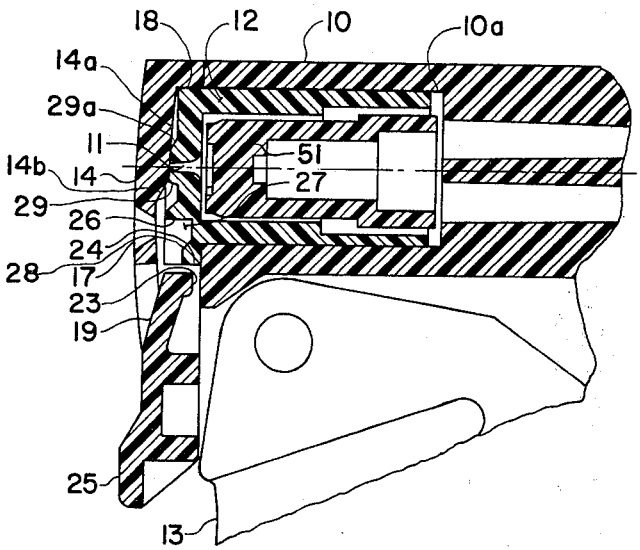
FIG. 2 is a sectional elevation showing the nose portion of the spray dispenser with the safety closure shown in the outlet closed position as in FIG. 1.
Figure 3:
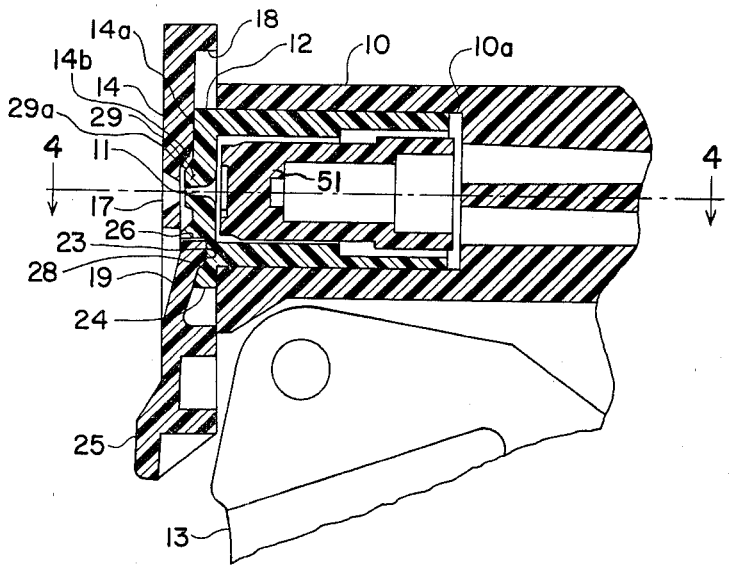
FIG. 3 is a sectional elevation corresponding to FIG. 2 with the safety closure shown in the outlet open position.
Figure 4:
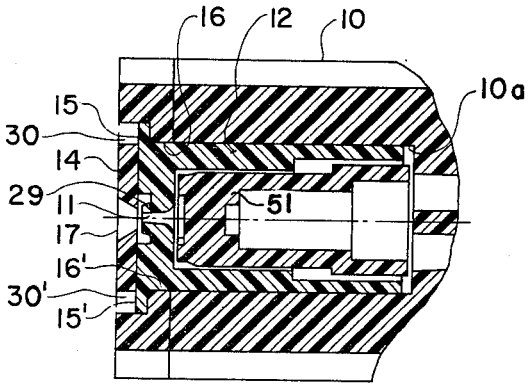
FIG. 4 is a top or plan section along line 4—4 in FIG. 3.
Figure 7:
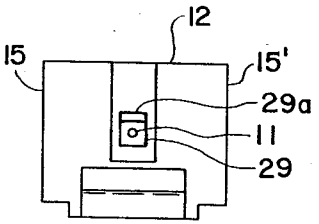
FIG. 7 is an enlarged front elevation of a nose piece or nose bushing used with the safety closure of FIGS. 1 through 6.
Figure 6:
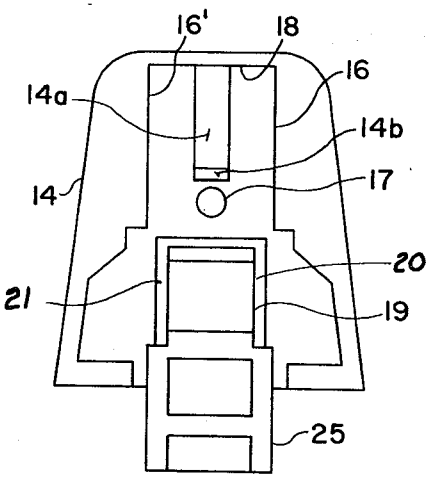
FIG. 6 is an enlarged rear elevation of the inside of the safety closure as viewed from the outlet in FIG. 1.

In the preferred embodiment of the present invention, particular reference being had to FIGS. 1 through 7, sprayer 10 is equipped with a planar safety closure in the form of a movable cover or overcap 14 slidably attached or coupled to nose piece or bushing 12 by a pair of spaced apart guide rails 15, 15' on nose piece 12 and cooperating overlapping, elongated lugs or rails 16, 16' on overcap 14, as best seen in FIG. 4, thereby providing retaining means for holding closure 14 on the end of sprayer 10 while simultaneously permitting it to be moved or displaced thereon. Guides 15, 15' are arranged in vertical parallel relation to lugs 16, 16' and to sprayer 10 when the latter is in the normal, upright position shown in FIG. 1. Thus installed overcaps 14 can slide up and down on these parts within certain limits, as will be explained. An opening or port 17 larger than outlet 11 of sprayer 10, is provided in overcap 14 and located therein so that when overcap 14 is moved to a position illustrated in FIGS. 3 and 4, port 17 will come into register with and completely uncover outlet 11. A downward movement limiting flange or limit stop 18 is provided on the upper end portion of overcap 14 which extends sufficiently rightwardly toward sprayer 10 to interfere, by engagement, with the upper side of nose piece 12 thereby preventing further downward motion of overcap 14 beyond the distance needed to completely cover outlet 11, as shown in FIG. 2.

Closure cover or overcap 14 includes a first deflective locking and unlocking portion or member 19 which is formed integrally with overcap 14 and extends upwardly thereon from a lower portion thereof, as best seen in FIGS. 2 and 3. A pair of vertical through slots 20, 21 are located in overcap 14 which extend therein from a point beyond the upper end of lock 19 downwardly to bottom of lock 19, leaving the narrow hinges, bands or pivots 22, 22' of material molded between the outer and center portions of the overcap 14. Hinges or bands 22, 22' are resilient since overcap 14 to which they are integrally connected is resilient and owing to the relatively narrow width of cross section at those points flex easily in torsion thereby acting as torsion springs to return lock 19 to its original relaxed, or unflexed position, as seen in FIG. 2. Also in FIG. 2, the upper end of lock 19 has a detent lip 23 which is in a position where it can intefere or engage with a shoulder or lip 24 formed in nose piece 12, thereby preventing further upward movement of overcap 14 when the latter is moved to the position shown in FIG. 3. Detent lip 23 also provides a lock when engaged on shoulder 24 for overcap 14 when the latter is in the first position shown in FIG. 2.

At the lower end of lock 19, best seen in FIGS. 2 and 3, an actuatable depressor or actuating tab 25 laterally extends and overlaps the outer, opposite sides or edges of slots 20, 21 and vertically extends below hinges 22, 22' where a pushing surface for the thumb of an operator is provided, for a purpose to be later explained. From the preceding, it will be obvious that lock 19 can be rotated counterclockwise or leftwardly about hinges 22, 22' in FIG. 2, at least to a small degree, when tab 25 is depressed to the right sufficiently for detent lip or interference tab 23 to clear shoulder 24 of nose piece 12, thereby freeing overcap 14 and permitting the latter to be pushed upwardly in a linear motion until lip 23 engages shoulder 26 of nose piece 12 and is seated in a recess 27 provided therein when finger pressure on tab 25 is released. When this action is completed overcap 14 is then retained in place in its "outlet open" or second position and operation of dispenser 10 to spray fluid can be commensed. The lower edge of the nose piece 12, where it is exposed to recess 27, is chamfered or formed with a ramp or ramped surface 28, best seen in FIG. 3. Lip 23 has a rounded lower edge or corner (see FIG. 2) which cooperates with the surface of ramp 28 and facilitates disengagement of lip 23 from recess 27 when a gentle, but firm downward pushing force is intentionally applied to the top of overcap 14.

Figure 5:
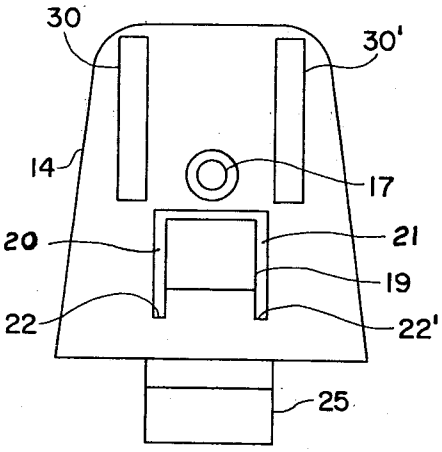
FIG. 5 is an enlarged front end elevation of the outside of the safety closure as viewed from the left in FIG. 1.
Figure 9:
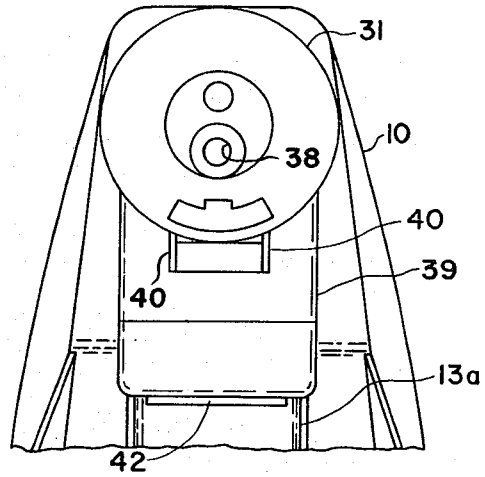
FIG. 9 is a front end elevation of the embodiment of FIG. 8, the safety closure in the outlet closed position.

An important additional and advantageous feature of the present invention will now be described which is the provision of a forcible seal which is intentionally provided between the interior of overcap 14 and the raised surface or boss 29 formed on nose piece 12 which surrounds and contains outlet 11, best seen in FIGS. 2 and 3. Boss 29 projects outwardly to the left in FIG. 2 toward overcap 14, has a top surface which is flat and in which outlet 11 terminates and a chamfered, or ramped upper side **29*a*. The inside, upper surface 14*a*, best seen in FIGS. 3 and 6, of overcap 14 rests against and abuts that portion of nose piece 12 below or to the right of boss 29 when overcap 14 is in its "outlet open" or second position. Two substantially parallel through slots 30, 30' are provided in the face of overcap 14 as shown in FIGS. 4 and 5. Slots 30, 30' extend downwardly from near the top of overcap 14 to a point immediately below port 17, and, as will be shown, provide an area therebetween which is flexible and which can be considered to be a second deflective portion of overcap 14. The lower edge of the upper inside surface of overcap 14 is also chamfered and formed into a ramp 14*b* and when it comes into contact with the also chamfered, ramp-like upper surface 29*a* of boss 29 facilitates downward movement of overcap 14 on surface 14*b* and provides a biasing effect forcing surface 14*a* against the top surface of boss 29 when overcap 14 is moved to the outlet closed or first position. When overcap 14 is returned again to its "outlet open" position surface portion 14*a*** again assumes its substantially flat unstressed, original condition owing to the resiliency of the material of which it is made.

Figure 8:
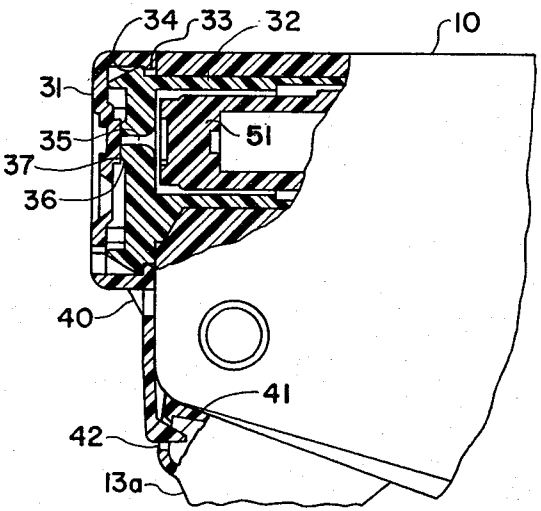
FIG. 8 is a vertical elevation, partially sectioned, of a dispenser nose portion and safety closure of another embodiment of the invention, the closure shown in place over the dispenser outlet in the outlet closed position.
Figure 11:
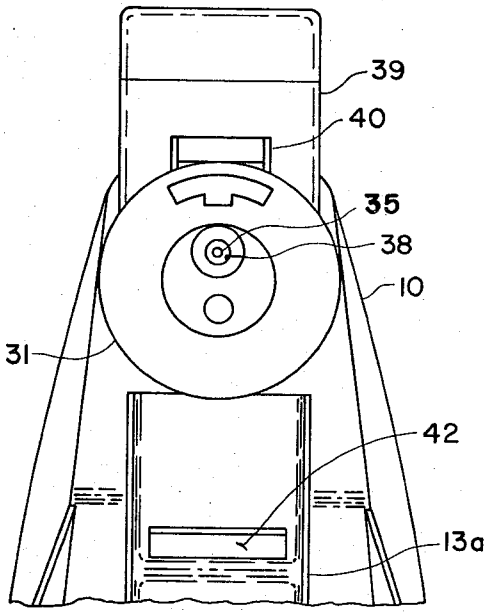
FIG. 11 is a front end elevation of the invention corresponding to FIG. 9, the safety closure shown in the outlet open position.
Figure 10:
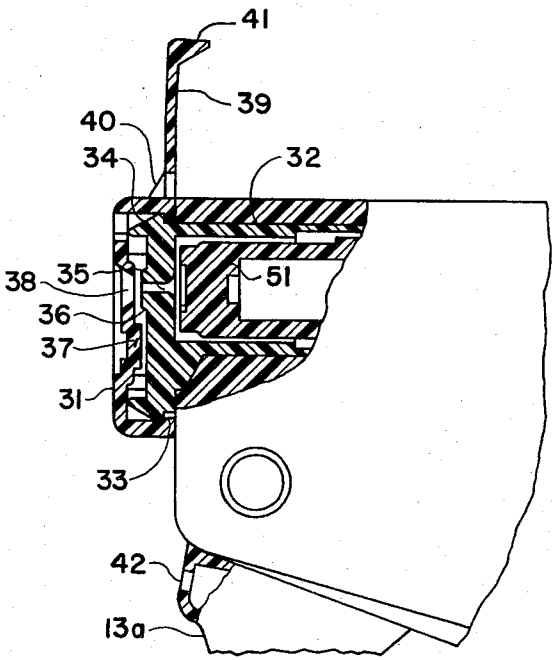
FIG. 10 is a vertical elevation, partially sectioned, of the invention corresponding to FIG. 8, the safety closure shown in the outlet open position.
Figure 13:
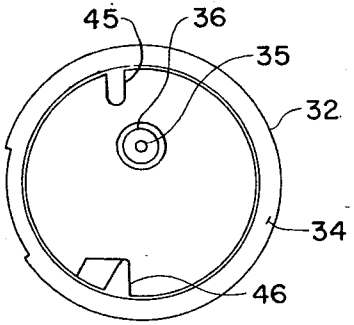
FIG. 13 is a front elevation of a nose piece or nose bushing used with the safety closure of FIGS. 8 through 12.
Figure 12:
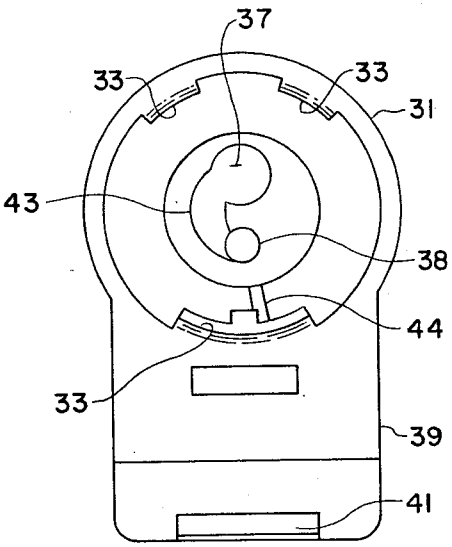
FIG. 12 is a rear elevation of the inside of the safety closure of the embodiment FIGS. 8 through 11 as viewed from the outlet.
Figure 14:
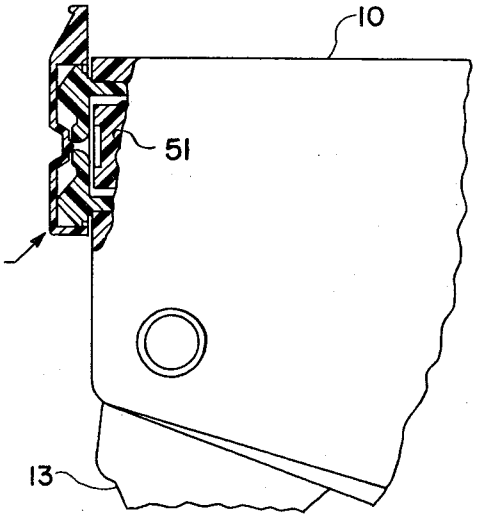
FIG. 14 is a vertical elevation, partially sectioned, of the nose portion of a typical spray dispenser with a prior art snap-on closure or overcap for the dispenser outlet.

Referring now to FIGS. 8–13, an additional embodiment of the present invention is disclosed wherein a modified planar safety closure, cover or overcap 31 is mounted on an also modified nose piece or nose bushing 32 in the end portion of sprayer 10 and is held tightly in place thereon by the annular lips 33 when cover or overcap 31 is installed thereon by snapping the same in place until lips 33 pass over the annular ridge 34 on nose piece 32, as best seen in FIG. 12. Overcap 31 is thus retained in place more or less permanently while still within certain limits being free to rotate thereon, as will later be described. On the other hand, overcap 31 cannot easily be removed as by use of the fingers, a tool or implement being required, without damage once in place because of its tight fit but, as will be seen, can be turned in a rotary, sliding motion with relative ease once it is, as will also be described hereinafter, "unlocked" by operation of its unlocking means. Nose piece 32 includes an outlet or orifice 35 which is eccentrically located with respect to the center of a circle defined by annular ridge 34, as best seen in FIG. 13, and has an exit plane terminating in the top surface (left in FIG. 10) of a raised boss or outlet projection 36 which surrounds outlet 35, as best seen in FIGS. 8 and 10. The top surface of boss 36 is substantially flat and mates with and abuts a similar flat surface on the inner boss or projection 37 on the interior surface of overcap 31, as shown in FIGS. 8, 10 and 12, when outlet 35 is closed to prevent spraying and to seal it from leakage during storage or shipping. Just below boss 37 on cap 31 (see FIGS. 8 and 12) a registerable outwardly chamfered opening or port 38 is formed through overcap 31, as best seen in FIGS. 8 and 10, which is made larger than outlet 35 and is chamfered outwardly of overcap 31 to facilitate passage of the fluid product sprayed from outlet 35 when port 28 is moved into alignment, i.e. registers with outlet 35, as will be hereinafter explained.

Referring now to FIG. 12 a ramp 43 is provided on the inside surface of overcap 31 which extends from the entrance to port 38 in an arcuate path terminating in the top surface of boss 37. Ramp 43 provides a wedging action as overcap 31 is rotated and ramp 43 moves over outlet boss 36 and outlet 35 is covered by the flat top surface of boss 37 (see FIG. 8). Both ramp 43 and boss 37 are so dimensioned with respect to outlet projection 36 that when boss 37 is in place covering outlet 35, sufficient force is generated thereby to provide a forcible seal for outlet 35 on the surface of projection 36. An enforced fluid tight product seal is thereby insured to enhance protection against leakage even in the event of unfortuitous operation of trigger 13*a*.

A radial projection 44 is formed on the inner surface of overcap 31, as shown in FIG. 12, which engages in abutting relation a similar projection or limit stop 45 on nose piece 32 (see FIG. 13) when overcap 31 is rotated to the position shown in FIG. 10. An additional projection or limit stop 46 diametrically opposite radial projection 44 on bushing 32 is also provided which engages stop 44 in abutting relation when overcap 31 is in the position shown in FIG. 8, thereby limiting rotation of overcap 31 in both clockwise and counterclockwise directions and insuring that the various parts and outlets are properly aligned or nonaligned as desired.

Extending below overcap 31, but integrally connected thereto is an actuating tab 39. Tab 39 is a generally flat piece having a pair of stiffening buttresses 40 molded between its outer surface and the rim-like lower portion of overcap 31. At, or approximately at, its mid-point tab 39 bends inwardly toward trigger 13*a* a slight amount. The lower end of tab 39 contains a tooth-like detent member 41 which extends rearwardly toward trigger 13*a* and engages the latter in a slot 42 therein, as shown in FIG. 8. The slight mid-point bend of tab 39 assures that member 41 is positively engaged in slot 42 and rotation of overcap 31 is prevented, conditions which will be maintained until a specific action or procedure is performed by the operator to change these conditions. Slot 42 is fabricated slightly longer in width and height than detent 41 so that the latter will be received therein easily; however, the depth of detent 41 is sufficient so that rotation of overcap 31 is substantially prevented. On the other hand, the depth of detent 41 is not so long that trigger 13*a* must be unduly depressed before detent 41 becomes disengaged from slot 42.

Figure 15:
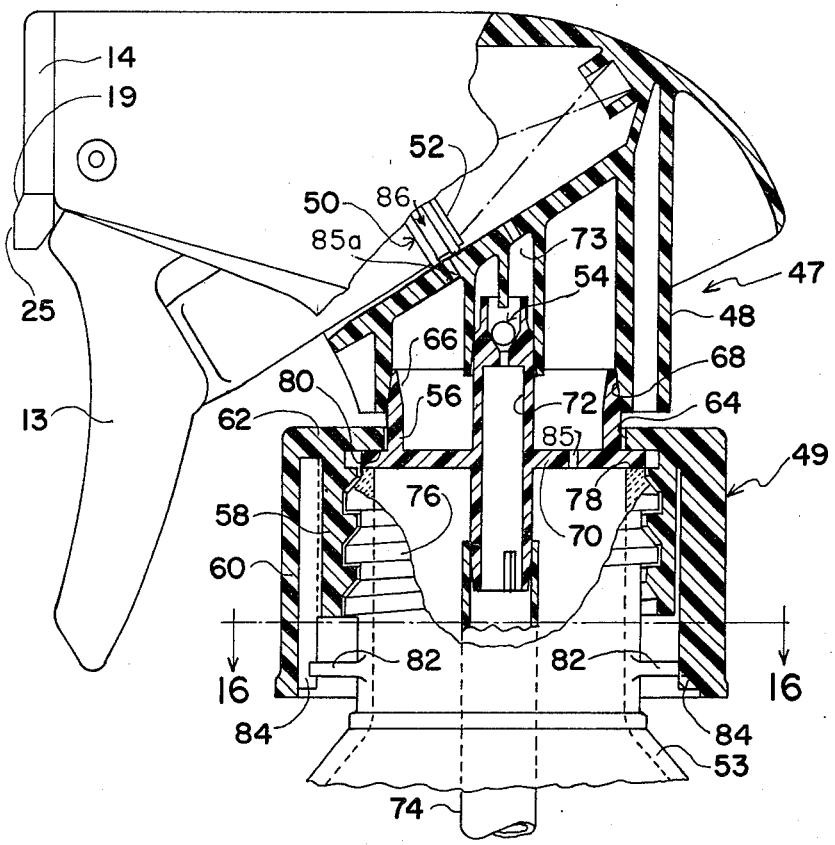
FIG. 15 is a vertical elevation, partially sectioned, of a further embodiment, of the invention, generally corresponding to the embodiment of FIG. 1, of a spray dispenser joined to a fluid container illustrating the interior and the interior working parts of a safety closing and connecting member for the dispenser.

A basic, generalized form of an additional preferred embodiment of the invention will now be described with reference to FIG. 15 wherein a child-resistant dispenser or sprayer 47 is disclosed having connected thereto on the bottom portion 48 thereof, a safety closing means in the form of a closing member 49. Sprayer 47 is identical in most respects to previously described sprayer 10 including trigger 13 and 13*a* and has a pumping mechanism 50 in the form of a reciprocating piston 52, associated inlet check valve 54 and an outlet valve (not shown in FIG. 15) which, however, may advantageously take the form of the check valve 51 in FIGS. 2, 3, 4, 8, 10 and 14. In addition, sprayer 47, like sprayer 10, can be and preferably is a molded article made entirely, or very nearly entirely, of plastic materials so as to be low cost and economical to manufacture. Particularly good examples of such materials, in addition to those mentioned previously, are any of the synthetic plastics and thermoplastics such as polyolefins, among which a particularly preferred one is polypropylene, although others of this class or group including polyethylene and polyisobutylene can also be used. Other synthetic and natural materials are also usable, for example, moldable thermoplastic polyester, polyurethane, nylon, polyvinylchloride, polyacetate, polystyrene, acrylonitrile butadiene styrene (ABS) and synthetic and natural rubber and mixtures of these materials. These materials possess elasticity, have the necessary resiliency and in addition, are economical, in relatively available and plentiful supply, are readily and easily formed by any of the well-known and widely used molding and casting manufacturing processes, and are inert to almost all of the commonly used materials and fluids which are packaged in containers with these devices.

As mentioned previously, sprayer 47 forms a package of material when attached and installed on a bottle or container 53 utilizing closing device or closing member 49 for the purpose. Member 49 is coupled to bottom or lower portion 48 by an intermediate insert, intake stem or coupling collar 56 and comprises an inner, cylindrical cap 58 having an internal threaded surface, an integral resilient outer skirt or cylinder 60 concentrically spaced from cap 58, and an integral top wall 62 from which these last named parts depend. Top wall 62 has a central perforation 64 through which the upper, cylindrical end 66 of intake stem or insert 56 easily passes with slight clearance to extend into the lower end of the bottom portion 48 of sprayer 47, being pressed fitted into an outer annular recess or cavity 68 contained therein. Cylindrical end 66 projects upwardly from the top surface of a laterally extending, disc-like support collar or base 70, the latter being a radial extension of a central conduit 74, which it supports. Collar or base 70 is larger in diameter than perforation 64 and supportably engages cap or skirt 60 on the underside or surface of top wall 62 of member 49. The upper end of conduit 72 terminates in a conical valve seat opening into a central cavity 73 in lower portion 48 of sprayer 47 and defines therewith a valve chamber in which intake or inlet check valve 54 is housed. Conduit 72 is press fitted into cavity 73 being engaged therein in fluid tight relation on its peripheral outer surface.

A fluid supply conduit or dip tube 74 which depends from the lower end of conduit 72, passes centrally through the threaded filler neck 76 of container or bottle 53 and terminates below the surface of the material contents (not shown) therein.

Sprayer 47 is packaged together with container 53 by engagement of internal threaded cap 58 on filler neck 76 when closing member 49 is screwed down thereon. When threaded cap 58 and filler neck 76 are fully engaged member 49 is in a closed position on container 53 in which base or support collar 70 is clamped tightly between the upper, annular surface 78 of container 53 and the under, annular surface 80 of top wall 62, the respective clamping surfaces 78 and 80 normally being smooth enough to provide an effective seal for container 53. In some instances a gasket or other seal enhancing device (not shown) may be advantageously used.

Figure 16:
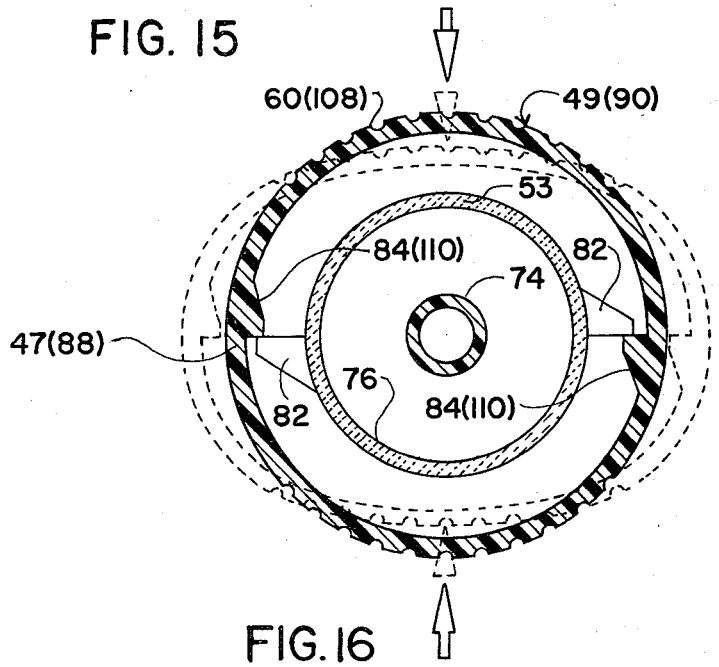
FIG. 16 is a transverse section taken along lines 16—16 of FIG. 15, and, FIG. 17 is a vertical elevation, partially sectioned, of still another embodiment of the invention.

A pair of wedge-shaped locking lugs 82 radially outwardly project from the lower peripheral surface, as best seen in FIG. 16, of filler neck 76 on opposite sides thereof and engage in locking, child-resistant relation, the cooperating vertically extending members or ribs 84 which radially inwardly project from the inside surface of outer closure skirt or cylinder 60. It will be appreciated, particularly in the light of the hereinafter following description of the operation of the invention, that the act of closing container 53 by screwing cap 58 of closing member 49 down on neck 76 will result in coaction between lugs 82 and ribs 84 which imparts child-resistant capability to these parts forming a special package significantly difficult for children under 5 years of age to open within a reasonable time.

Turning again to FIG. 15, dispenser-sprayer 47 comprises a spring loaded piston 52 mounted for reciprocation within sprayer 47 by actuator trigger 13. Trigger 13 is pivotably mounted on sprayer 47 on its outer portion and extends below its forward or outlet end. Also housed within the body of sprayer 47 is an entrance or intake passage in an internal wall or partition leading into a pump chamber from the intake valve chamber therebelow. An exit conduit or discharge passage is also provided which connects the chamber with the outside through outlet or discharge check valve 51 via nose bushing or nose piece 12, previously described.

Outlet or discharge check valve 51 is slidably positioned in an internal cavity in nose bushing 12 to control the flow of the material, usually fluid contents of container 53 pumped thereto for ejection through the ejection orifice or outlet 11 when overcap 14 is in its open position.

To insure container 53 is properly vented and the pressure therein equalized during pumping of the material contents therefrom suitable vent passages are provided, one, a through passage 85 in base or support collar 70 of coupling stem member 56 and an additional passage 85*a* in an internal wall or partition of the piston bore, the latter being molded at a point immediately under piston 52. In FIG. 15, piston 52 is shown in its normal, non-pumping, or at rest position, and vent passage 85*a* is closed and sealed against ambient air by the spaced seal rings 86 on piston 52 arranged on either side of the passage. During a pumping stroke of piston 52, however, vent passage 85*a* is uncovered and ambient air enters container 53 via the open passage and a similar passage in base 70.

Figure 17:
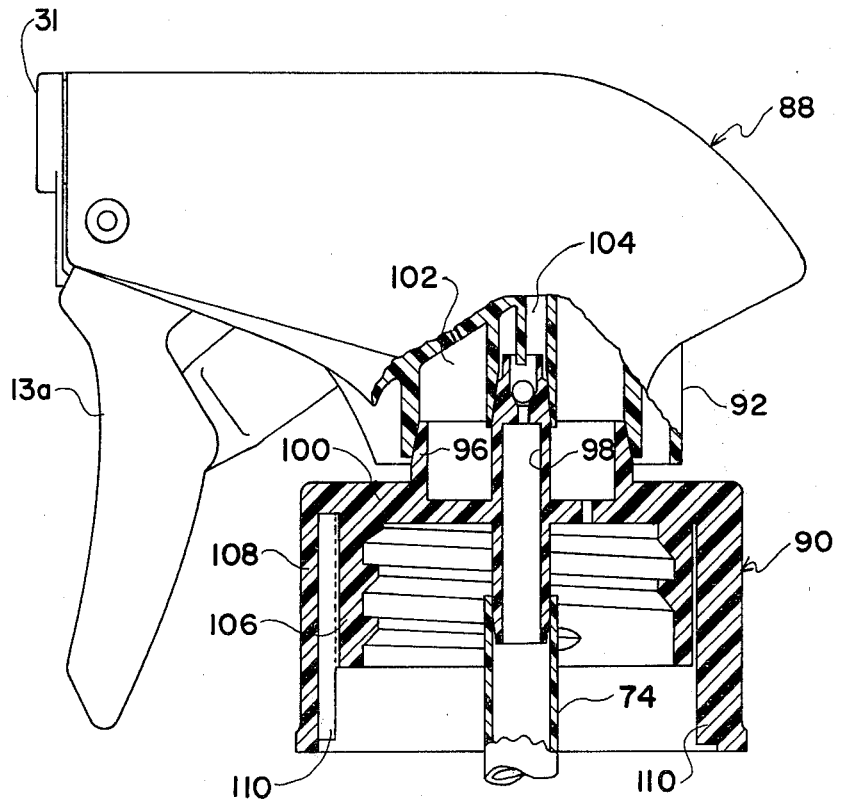

Turning now to FIG. 17, an additional embodiment of the invention is illustrated wherein a sprayer 88, similar in operation and in all other important aspects to the previously described embodiments, includes a modified container closing device or member 90. For illustrative purposes only, since overcap 14 and bushing 12 could just as easily be used, sprayer 88 is equipped with rotating child-resistant overcap 31 and trigger 13*a* of FIGS. 8 through 13. Closing member 90 is connected to the bottom or lower portion 92 of sprayer 88 by known means, as for example, spin welding, adhesive bonding or the like after preassembly. In FIG. 17 member 90 includes an integrally molded part in the form of an intake stem 94 having an upper molded cylindrical end 96 for connecting by press fit, member 90 to lower or bottom end 92 of sprayer 88. It will be appreciated that the use, as in FIG. 17, of integrally molded stem 92 will permit some cost savings in manufacture owing to the elimination of at least one discrete manufactured part, namely intermediate intake stem 56. Integrally molded in stem 94 is a central inlet conduit 98 which is supported directly on the top integral wall 100 of member 90. Intake or insert stem 94 extends upwardly from top wall 100 into the outer, annular cavity 102 in lower portion 92 and the upper end of conduit 98 extends into an inner central cavity 104 being press fitted the rein as in the FIG. 15 embodiment. Closing member 90 is otherwise structurally identical to closing cap member 49 including an inner cap or cylinder 106 with an internal threaded surface (corresponding to cap 58) and a resilient outer skirt 108 (corresponding to skirt 60), both of which depend in integral, concentrically spaced apart relation, from integral top wall 100. In addition, the inner surface of outer resilient skirt 108 carries a pair of identically formed, vertically extending, radially projecting ribs 110 which coact with and engage cooperating lock members or lugs 82 on filler neck 76 of container 53 when the latter is closed by screwing cap 106 of closing member 90 down thereon, thereby forming a child-resistant package, as in the previously described FIG. 15 embodiment.

In the course of installing sprayer 88 on container 53 to close the same, it should be noted that, owing to the unitary integral structure of closing member 90 and its press fitted and/or welded connection to sprayer 88, the entire assembly will turn as a unit when cap member 90 is screwed down onto filler neck 46. In contrast, the embodiment of FIG. 15 is a swivelled connection and when member 49 is mounted on dispenser 47, cap 58 is screwed down on filler neck 76 by turning closing member 49 independently of insert stem 56 to close container 53.

OPERATION OF THE INVENTION

With respect to the operation of the present invention, references will be had to the terms "Packaging" and/or "Special Packaging" which terms will have the same meaning given and defined in Title 16 of the Code of Federal Regulations, Part 1700.1 through 1700.20, Sub-chapter E-Poison Prevention Packaging Act of 1970-Regulations aforementioned.

With sprayer 10 mounted and container 10*b* shown in FIG. 1 filled with fluid product to be dispensed, the operator normally will pick up the assembled device by its neck and with his fingers squeeze the trigger to initiate spraying action. In FIG. 1, however, no spray will emerge from outlet 11 since it is blocked by overcap 14, which is in its outlet closed position. It therefore becomes necessary to move overcap 14 to its outlet open position to remove the blockage from outlet 11 so that spraying may be effected. In the embodiment shown in FIGS. 1 through 7, an operator's natural inclination, especially a young child's, will be to try to remove overcap 14 by prying it off, most likely by pulling tab 25 away from dispenser 10, which action is prevented owing to engagement of guides 15, 15' on rails 16, 16'. Instead, tab 25 must be pushed in an opposite direction or inwardly, and unnaturally, toward the right as a first motion or step, which causes slight counterclockwise rotation of lock 19 about hinge points or flexible bands 22, 22', and causes lip 23 to move or be displaced leftwardly in FIG. 2 until it clears shoulder 24. With this motion or step concluded, upward motion of overcap 14 is permissible, which, when accomplished, as a second motion or step, causes lip 23 to enter recess 27 under the urging of biasing torsion forces induced in bands 22, 22'. Overcap 14 will then slide upwardly to its "outlet open" position in which outlet 11 becomes unblocked as port 17 is brought into register therewith. In this "outlet open" or second position, spraying can be effected in the usual manner. When spraying ceases, overcap 14 is urged downwardly with a gentle but firm push of the finger until further movement in that direction is halted as lip 23 bears against and abuts the upper edge of nose piece 12. Outlet 11 is once again blocked and, as previously described, port 17 moves out of register therewith, lip 23 rides up and out of recess 27 and springs back under urging of springs 22, 22' to its initial position under shoulder 24 and overcap 14 resumes its "outlet closed" position.

With reference to the second safety outlet cover or overcap embodiment of the invention, shown in FIGS. 8 through 13, overcap 31 is assumed to be in its FIG. 8 or "outlet closed" position. In this position tab 39 is extended downwardly and detent or tooth 41 is engaged in slot 42 of trigger 13*a*. Tab 39 thus locked, cannot be moved, i.e., rotated without performing a specific set of procedural steps. For example, to open outlet 11 of dispenser 12, it is, as a first step, necessary for the operator to depress trigger 13*a* slightly by a squeezing action of the fingers until slot 42 is withdrawn from detent 41. At this point a second motion or step must be performed wherein the operator rotationally moves or slides tab 39 and overcap 31 upwardly or counterclockwise as viewed in FIG. 11 or until tab 39 has reached the position of FIG. 11 in which it extends straight up. At this position further rotation is estopped by limit stop 44 as it contacts and abuts stop 45. Put another way, overcap 31 must be rotated through an arc of approximately 180 degrees which causes overcap 31 to slide in rotation over the end of nose piece 32 and eccentrically located boss 37 retreats from its position covering outlet 35. Overcap 31 thus reaches its "outlet open" position and, simultaneously, port 38 in cap 31 is brought into register with outlet 35. Fluid product can now pass through outlet 35 and be ejected from port 38.

As an added safety feature, overcap 31 and associated tab 39 are by placement of respective limit stops 45 and 46 on nose piece 34 permitted rotation in only one direction (counterclockwise) for the reason that most young children are likely to abandon further attempts to open overcap 31 if they find, on first attempt, they are unable to "work it", thus further reducing the likelihood of accidental or inadvertent operation and spraying.

When spraying operations are concluded tab 39 and associated overcap 31 are rotated and swung through a clockwise arc of approximately 180 degrees until limit stop 44 on overcap 31 contacts and abuts stop 46 on nose piece 32. In this condition overcap 31 is once again in the "outlet closed" position, tab 39 extends downwardly and detent 41 is once again engaged by trigger 13*a* in slot 42. To insure engagement of detent 41 in slot 42, trigger 13*a* is depressed, i.e. pulled back slightly or sufficiently to allow detent 41 to clear the front edge of trigger 13*a*, following which trigger 13*a* is released as detent 41 penetrates slot 42 and overcap 31 is locked in its "outlet closed" position. During rotation of overcap 31 to this position, ramp 43 provides an arcuate, inclined path over which outlet projection 36 moves in a camming action against the top surface of boss 37 to provide a forcible seal against leakage through outlet 35.

As indicated previously, the basic preferred invention is depicted in FIGS. 1 through 13. In FIGS. 15 through 17 additional embodiments are illustrated the operation of which will now be described to provide a clearer understanding of certain advantageous aspects of the invention. Particular reference should be had also to FIG. 16, since the principles there illustrated are applicable in common to the embodiments of FIGS. 15 and 17, and a fully child-resistant sprayer-container or package is presented.

Container 53 is closed when sprayer 47 (or sprayer 88) is mounted thereon by screwing down onto filler neck 56 cap 58 (or 106), which action causes ribs 84 (or 110) on skirt 60 (or 108) to engage locking lugs 82 on filler neck 76 of container 53. When fully engaged, as indicated in FIG. 16, sprayer 47 (or 88) is locked securely on container 53 and a child-resistant "Special Package" is formed thereby. It will readily be appreciated that when fully engaged in the position indicated any attempt to gain access to container 53 by removing sprayer 47 (or 88) from filler neck 76 will result in failure since engaged ribs 84 (or 110) and lugs 82 will resist and prevent such action unless certain procedures are performed to unlock them, which procedures will be fully described in the hereinafter following discussion of a testing program undertaken to determine whether small children under the age of 5 years would be able to uncover outlet 14 to spray material or open container 53 to gain access thereto. At the same time, other tests were undertaken to determine whether normal adults over 18 years of age would be able to uncover outlet 14 or open container 53.

It is, of course, highly desirable to be able to open container 53 for refilling after emptying of its contents. To accomplish this certain procedures must be performed which will now be described with reference to FIG. 16. As indicated by the arrows in FIG. 16, compressive stress is applied to skirt 60 (or 108) by squeezing the grooved side portions thereof to deform skirt 60 (or 108), as indicated by the dash lines in FIG. 16. As skirt 60 (or 88) deforms, ribs or locking members 84 (or 110) carried thereon are displaced outwardly a short distance sufficient to clear lugs 82 on filler neck 76 of container 53. Member 49 (or 90) can then be rotated or unscrewed a short way or until ribs 84 (or 110) and lugs 82 are fully disengaged, after which sprayer 47 (or 88) can be unscrewed all the way and removed. It will be appreciated from the foregoing that two discrete and simultaneously performed operations or procedural steps are required before container 53 can be opened by removal therefrom of sprayer 47 (or 88) which operations are; (1) a deforming compressive stress, as by squeezing applied to skirt 60 (or 88) sufficient to cause a radial displacement of locking members 84 (or 110) to disengage them from lugs 82 and, (2) skirt 60 (or 108) maintained in its deformed state while simultaneously unscrewing closing member 49 (or 90) and cap 58 (or 106) thereof a short distance sufficient to disengage ribs 84 (or 110) from lugs 82 after which sprayer 47 (or 88) can be removed.

As previously mentioned, it is economically desirable to ship, as filled, closed packages, i.e., loaded articles such as the herein described sprayers already installed on their filled containers. It is also desirable to insure that when so shipped, the packages are leak proof and child-resistant. Until the present invention, however, really effective child-resistant sprayer-container packages capable of meeting the standards prescribed in the aforesaid Federal Regulations for Special Packaging have not been available. In other words, when the present invention depicted in FIGS. 15 and 17, is formed into a package with filled container 53 and is equipped with one of the child-resistant overcaps 14 or 31 of FIG. 2 or FIG. 8, such "Special Package" for the first time is the result.

To determine whether the present invention packaged with a polyethylene bottle or container would satisfy the Consumer Product Safety Commission standards for Poison Prevention Packaging according to the protocol and standards set forth in aforementioned Title 16, Code of Federal Regulations, Parts 1700 through 1700.20, special packagings of sprayers 47 and container 53 were prepared in sufficient number to test in accordance with Part 1700.20 sub-section (a) through (c) thereof entitled "Testing Procedure for Special Packaging". The tested spray devices were made in accordance with the aforedescribed sprayer 47 illustrated in FIG. 15 equipped with child-resistant closing member 49 connected on bottom portion 48 thereof and with child-resistant overcap 14.

The above described package was tested and evaluated for its child-resistant effectiveness and its adult use effectiveness by panels consisting of 200 children and 100 adults obtained from nursery schools, day care centers and civic groups.

The two hundred children employed as panelists for the tests were between the ages of 42 and 51 months and substantially evenly distributed by age and sex as follows:

(1) Twenty children (plus or minus 10 percent) whose nearest age was 42 months, 20 children whose nearest age was 43 months, 20 at 44 months etc., up to and including 20 at 51 months of age; and, (2) The children were divided into groups of two each and given five minutes to open the containers and/or uncover sprayer outlet 11 by moving overcap 14 into its outlet open position. For each test the paired children received the same special package simultaneously with no demonstration or instructions and were asked to open the packages in the time allotted. Results of these tests are given in Table I.

TABLE I

| NO DEMONSTRATION | | | | | |
|---|---|---|---|---|---|
| | | | | Successful Openings | |
| Ages of Panelists | Panelists Tested | | | Assembly 10 | Overcap 14 male & |
| Months | Male | Female | Total | Male & Female | Female |
| 42 | 9 | 11 | 20 | 0 | 0 |
| 43 | 11 | 9 | 20 | 0 | 0 |
| 44 | 10 | 10 | 20 | 0 | 0 |
| 45 | 10 | 10 | 20 | 0 | 0 |
| 46 | 10 | 10 | 20 | 0 | 0 |
| 47 | 10 | 10 | 20 | 0 | 0 |
| 48 | 10 | 10 | 20 | 0 | 0 |
| 49 | 10 | 10 | 20 | 0 | 0 |
| 50 | 10 | 10 | 20 | 0 | 0 |
| 51 | 10 | 10 | 20 | 0 | 0 |
| Totals | 100 | 100 | 200 | 0 | 0 |
| Percent Unsuccessful | | | | 100% | 100% |

From Table I none of the panelists were successful in either activating the spray, which requires being able to slide overcap 14 to its outlet open position, or removing sprayer 47 from container 53, which requires applying a deforming force against skirt 60 sufficient in magnitude and direction to disengage ribs 84 from lugs 82 to unlock closing member 49.

The tests were repeated with the same panelists except in this instance a demonstration was given of the correct way to open container 53 and move overcap 14 to its open position.

The results for these tests given the same panelists are presented in Table II.

TABLE II

| WITH DEMONSTRATION | | | | | | | | |
|---|---|---|---|---|---|---|---|---|
| | Panelists | | | Successful Openings | | | | |
| Ages of | Tested | | | Assembly 10 | | Overcap 14 | | |
| Panelists Months | Male | Female | Total | Male | Female | Male | Female | Total |
| 42 | 9 | 11 | 20 | 0 | 0 | 0 | 0 | 0 |
| 43 | 11 | 9 | 20 | 0 | 0 | 0 | 0 | 0 |
| 44 | 10 | 10 | 20 | 0 | 0 | 0 | 0 | 0 |
| 45 | 10 | 10 | 20 | 0 | 0 | 0 | 0 | 0 |
| 46 | 10 | 10 | 20 | 0 | 0 | 0 | 0 | 0 |
| 47 | 10 | 10 | 20 | 0 | 0 | 0 | 0 | 0 |
| 48 | 10 | 10 | 20 | 0 | 0 | 0 | 0 | 0 |
| 49 | 10 | 10 | 20 | 0 | 0 | 0 | 0 | 0 |
| 50 | 10 | 10 | 20 | 0 | 0 | 1 | 0 | 1 |
| 51 | 10 | 10 | 20 | 0 | 0 | 0 | 0 | 0 |
| Totals | 100 | 100 | 200 | 0 | 0 | 1 | 0 | 1 |

TABLE II-continued

| WITH DEMONSTRATION | | | | | | | | |
|---|---|---|---|---|---|---|---|---|
| | Panelists | | | Successful Openings | | | | |
| Ages of | Tested | | | Assembly 10 | | Overcap 14 | | |
| Panelists Months | Male | Female | Total | Male | Female | Male | Female | Total |
| Percent Unsuccessful | | | | 100% | | 98% | | 99.5% |

Based upon the standards of child-resistant effectiveness of not less than 85% without demonstration and not less than 80% after demonstration of the proper means of opening a special packaging as established in the Protocol for testing such special packaging, the present combined child-resistant dispenser 47 and closing member 49, equipped with child-resistant overcap 14 and packaged with container 53 easily fulfills the requirements for Poison Prevention Packaging prescribed in Part 1700 of Title 16 of the Code of Federal Regulations. The effectiveness as measured by the percent of *unsuccessful* openings *Without Demonstration* (Table I) and With Demonstration (Table II) is as follows:

WITHOUT DEMONSTRATION

100% with respect to both opening and gaining access to the package contents by removing sprayer 47 or shifting overcap 14 to its outlet open position.

WITH DEMONSTRATION

100% with respect to closing member 47, 99% with respect to overcap 14 and 99.5% with respect to entire sprayer unit.

The same tests of the same special packaging as in Tables I and II were given to a group of panelists composed of 100 adults ranging in age from 18 to 45, 70 of whom were women, and 30 of whom were men. No demonstration was made; however, directions and instructions were given as follows:

CLOSING MEMBER

To Open

Press opposite sides of cap at bottom of grooved portion with thumb and forefinger and twist bottle clockwise.

OVERCAP SPRAY TAB

To Open

1. Overcap must be flush with top of sprayer.
2. With thumb or finger, press in and up on tab.

Instructions To The Testing Persons

The interviewers, or testing personnel were directed to conduct the evaluation of the devices strictly according to the cited protocol. To help insure the test personnel adhered to the above, they were periodically observed throughout the testing program.

Results for the adult group are given in Table III.

TABLE III

| Panelists Tested | | Successful Panelists Without Demonstration | |
|---|---|---|---|
| (Number) | | Overcap 14 | Closure Section 14 |
| Female | 70 | 68 | 63 |
| Male | 30 | 30 | 30 |
| Total | 100 | 98 | 93 |

TABLE III-continued

| Panelists Tested (Number) | Successful Panelists Without Demonstration | |
|---|---|---|
| | Overcap 14 | Closure Section 14 |
| Percent Successful | 98.0 | 93.0 |

WITH DEMONSTRATION

The two panelists who were unable to operate and shift overcap 14 to its outlet open position were able to activate it after a demonstration of the correct way to do so.

Four of the seven panelists unable to open container 53 by removing sprayer 47 were still unable to open it after a demonstration.

Based upon the standard of adult-use effectiveness of not less than 90 percent, at least one embodiment of the present invention, as described herein, fulfills the requirements for Poison Prevention Packaging based upon the protocol and standards set forth for same in Part 1700 of Title 16 of the Code of Federal Regulations.

What is claimed is:

1. An overcap for selectively closing and opening the outlet orifice of a liquid dispenser having a nose bushing in which said orifice is formed, said overcap being coupled to said nose bushing for sliding movement with respect thereto between a first or orifice closing position and a second or orifice opening position, said overcap including a first portion that is deflective with respect to said nose bushing and having detent means formed thereon, said detent means cooperating in a locking relationship with a surface of said nose bushing to hold said overcap against sliding movement when said overcap is in said first position, deflection of said portion of said overcap being operative to release said detent from locking relationship with said nose bushing whereby said overcap is movable to said second position from said first position, and wherein said overcap includes a second deflective portion spaced from said first deflective portion, said second deflective portion having a ramp surface provided thereon adjacent said nose bushing, said ramp surface cooperating with said nose bushing to produce an interference fit in the engagement of said orifice by said overcap as said overcap is moved from said second position to said first position.

2. An overcap for selectively closing and opening the outlet orifice of a liquid dispenser having a nose bushing in which said orifice is formed, said overcap being coupled to said nose bushing for sliding movement with respect thereto between a first or orifice closing position and a second or orifice opening position, said overcap including a first portion that is deflective with respect to said nose bushing and having detent means formed thereon, said detent means cooperating in a locking relationship with a surface of said nose bushing to hold said overcap against sliding movement when said overcap is in said first position, deflection of said portion of said overcap being operative to release said detent means from locking relationship with said nose bushing whereby said overcap is movable to said second position from said first position, and wherein an opening provided in said overcap is in register with said orifice when said overcap is in said second position, said overcap includes a second deflective portion spaced from said first deflective portion, said second deflective portion having a ramp surface provided thereon adjacent said nose bushing, said ramp surface cooperating with said nose bushing to produce an interference fit in the engagement of said orifice by said overcap as said overcap is moved from said second position to said first position, said first deflective portion of said overcap includes pivot means provided at an intermediate position thereof, and said coupling means includes stop means to limit the sliding movement of said overcap relatively to said nose bushing whereby said overcap is non-removable from said nose bushing.

3. For use with a liquid dispenser having a nose bushing in which an orifice is provided, an overcap coupled to the nose bushing for selectively closing and opening said orifice, means coupling said overcap to the nose bushing for orifice engaging, sliding movement between a first position in which said overcap engages the orifice to close the orifice against the flow of liquid therefrom, and a second position in which no portion of said overcap engages the orifice, a portion of said overcap depending below said nose bushing, said depending portion having a first, normally undeflected position, and a second deflected position, said depending overcap portion being provided with an interference tab at one end and an actuating tab at the other end, and locking means on said nose bushing cooperating with said interference tab to lock said overcap against sliding movement toward said second position when said overcap is in said first position and said depending portion of said overcap is undeflected, movement of said depending portion to said second, deflected, position by actuation of said actuating tab operating to release said interference tab from locking relationship with said locking means whereby said overcap is movable to said second position by actuation of said actuating tab.

4. Apparatus as specified in claim 3 wherein the direction of deflection of said depending portion of said overcap required to release said interference tab is transverse with respect to the direction of the sliding movement of said overcap relatively to said nose bushing.

5. Apparatus as specified in claim 4 wherein the direction of deflection of said depending portion of said overcap to release said interference tab is toward said nose bushing.

6. Apparatus as specified in claim 3 including ramp means provided on said overcap, said ramp means cooperating with said nose bushing upon movement of said overcap from said second position to said first position thereof to develop and hold by dimensional interference a closing pressure upon said orifice.

7. Apparatus as specified in claim 3 wherein said coupling means comprises tab means on the nose bushing, said tab means retaining said overcap on said nose bushing but allowing sliding movement of said overcap relatively to said nose bushing.

8. Apparatus as specified in claim 3 wherein an opening provided in said overcap is in register with the outlet orifice in said nose bushing when said overcap is in said second position thereof.

9. Apparatus as specified in claim 3 including a recess on said nose bushing, and detent means on said overcap cooperating with said recess to provide a stop upon movement of said overcap to said second position and serving to hold said overcap in said second position.

* * * * *